US006575301B2

(12) United States Patent
Simhaee

(10) Patent No.: US 6,575,301 B2
(45) Date of Patent: Jun. 10, 2003

(54) PLASTIC BAG PACKAGE

(76) Inventor: Ebrahim Simhaee, 112 N. Maple Dr., Beverly Hills, CA (US) 90210

( * ) Notice: Subject to any disclaimer, the term of this patent is extended or adjusted under 35 U.S.C. 154(b) by 141 days.

(21) Appl. No.: 09/906,274

(22) Filed: Jul. 16, 2001

(65) Prior Publication Data

US 2003/0010669 A1 Jan. 16, 2003

(51) Int. Cl.[7] ..... B65D 85/62
(52) U.S. Cl. ..... 206/554; 206/499
(58) Field of Search ..... 53/426, 429, 443, 53/446, 447; 206/83.5, 499, 526, 554

(56) References Cited

U.S. PATENT DOCUMENTS 2,925,175 A * 2/1960 Williamson et al. ..... 206/554
3,420,433 A * 1/1969 Bostwick ..... 206/554
3,467,249 A * 9/1969 Calvert ..... 206/554
3,809,235 A * 5/1974 Edwards et al. ..... 206/499
4,453,649 A * 6/1984 Origuchi ..... 206/554
4,506,801 A * 3/1985 Origuchi ..... 206/554
4,512,476 A * 4/1985 Herrington, Jr. ..... 206/554
4,877,473 A 10/1989 Snowdon et al. ..... 156/204
5,464,098 A 11/1995 Tseng et al. ..... 206/554
6,385,948 B1 * 5/2002 Schneider et al. ..... 53/447

* cited by examiner

*Primary Examiner*—Jim Foster
(74) *Attorney, Agent, or Firm*—Darby & Darby

(57) ABSTRACT

A package of plastic bags, preferably T-shirt bags, is disclosed. The bags are provided in separate bundles with a predetermined number of bags in each bundle. One third of each bundle is folded over the remaining two thirds. Pairs of nested bundles are placed in a box with each pair including a bundle having its edges facing one direction and an adjacent bundle with its edges facing in the opposite direction, the edges of the short portions abutting against each other. Typically, each box will contain five or ten pairs of such interlocked bundles.

6 Claims, 2 Drawing Sheets

PLASTIC BAG PACKAGE

This invention relates to the packaging of plastic bags and, in particular, to the packing of T-shirt bags.

BACKGROUND OF THE INVENTION

Plastic bags of the type known as T-shirt bags are widely used throughout the world. A T-shirt bag is typically formed from a tube of extruded plastic (e.g. polyethylene). The tube is gussetted and seal lines are formed in the gussetted flattened tube to form blanks from which the individual bags are formed. The blanks are cut from the moving tube and bundled, for example, in stacks of 50 to 100 blanks. These blanks are then passed to a cutting station where the handles are die cut to form the individual T-shirt bags. T-shirt bags come in different forms and different sizes and very often include tabs or the like to help mount the bags on a supporting rack. U.S. Pat. Nos. 4,877,473 and 5,464,098 are representative of T-shirt bags.

After manufacture, each bundle is folded in half and placed in a corrugated cardboard box for transportation and storage. FIGS. 1 and 2 show a prior art package in which a bundle of T-shirt bags is placed in a cardboard box 12 shaped to receive the bundle. In FIG. 1, the bundle 10 is folded in half with the open end facing to the left and the folded end to the right. The second folded bundle is placed in the box, as shown in FIG. 2, and positioned so that its open end faces to the right. This is done to compensate for the greater thickness of the bags at the bottom and top seals. Because the bags are folded in halt, the added thickness of the seals causes the bundle to be thicker at its open end as compared to the folded end.

Typically, each box contains 1000 bags, i.e. ten or twenty bundles of one hundred or fifty bags each. Due to the greater thickness of each bundle at its ends, the stack tends to form a depression in the center. The last bundle is usually folded in thirds and placed in the center of the bundle to fill the entire volume of the box.

The handles of the bags are relatively slippery and because of the way in which the bundles are stacked, one on top of the other, the free ends of the handles 10C may tend to shift from their position in the corner of the box during handling and transportation. If this should happen, the stack of bundles becomes unstable and the weight of the bundles needs to be supported by the box. This means that the boxes must be relatively strong which is a factor in the cost of the package as well as transportation.

The invention provides a new way of packaging plastic bags, and in particular, T-shirt bags, in which the stack of bundles is more stable than in the prior art. As a result, the weight bearing capability of the package can be less than in the prior art. This means that the box can be made of thinner, i.e. less expensive, material.

SUMMARY OF THE INVENTION

In accordance with the invention, each bundle of bags is folded to form a long and a short portion. Preferably, a third of the bundle is folded over the remaining two thirds so that the long portion is twice as long as the short portion. Each bundle is then placed in the box so that the ends of the bundles in a pair of bundles abut against each other. As a result of this nesting arrangement, the tendency of the bottom or folded part of the bundles to shift during packing, transportation and/or handling is reduced and the stack of bundles at the four corners of the box is more stable. Consequently, the weight bearing capability of the box can be less than before.

DETAILED DESCRIPTION

Figure 1:
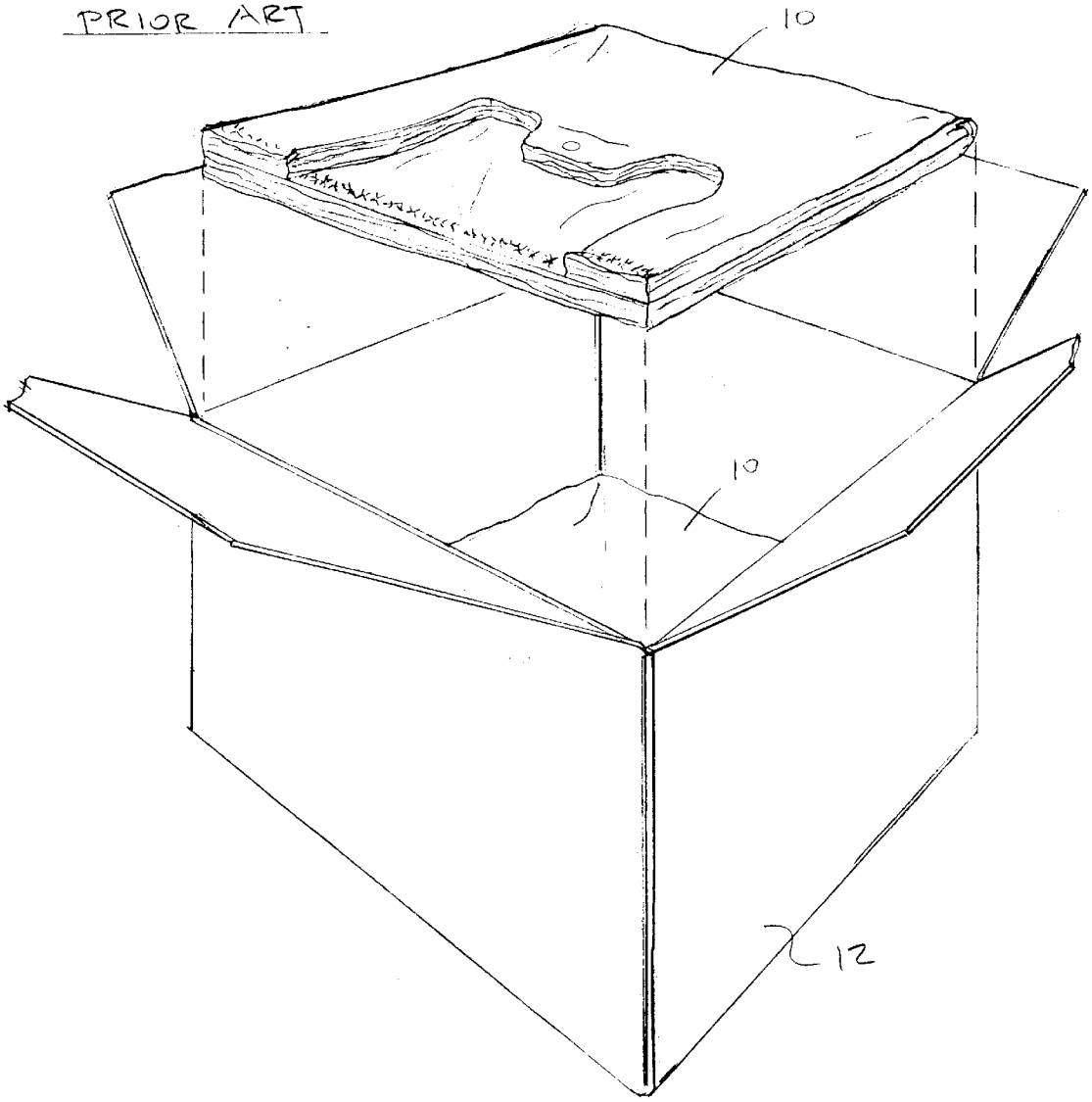
FIG. 1 PRIOR ART
FIG. 1 is an exploded view of the prior art T-shirt bag package.
Figure 2:
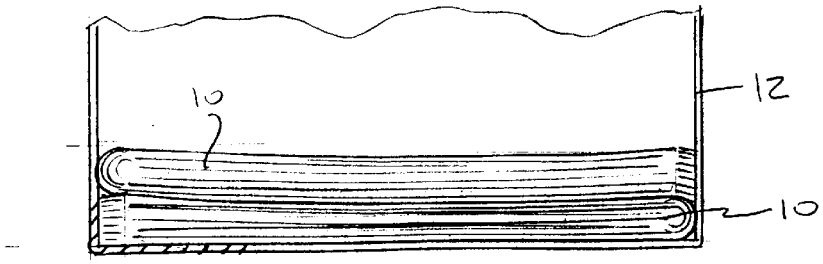
FIG 2 PRIOR ART
FIG. 2 is an end view of the prior art T-shirt bag package.
Figure 3:
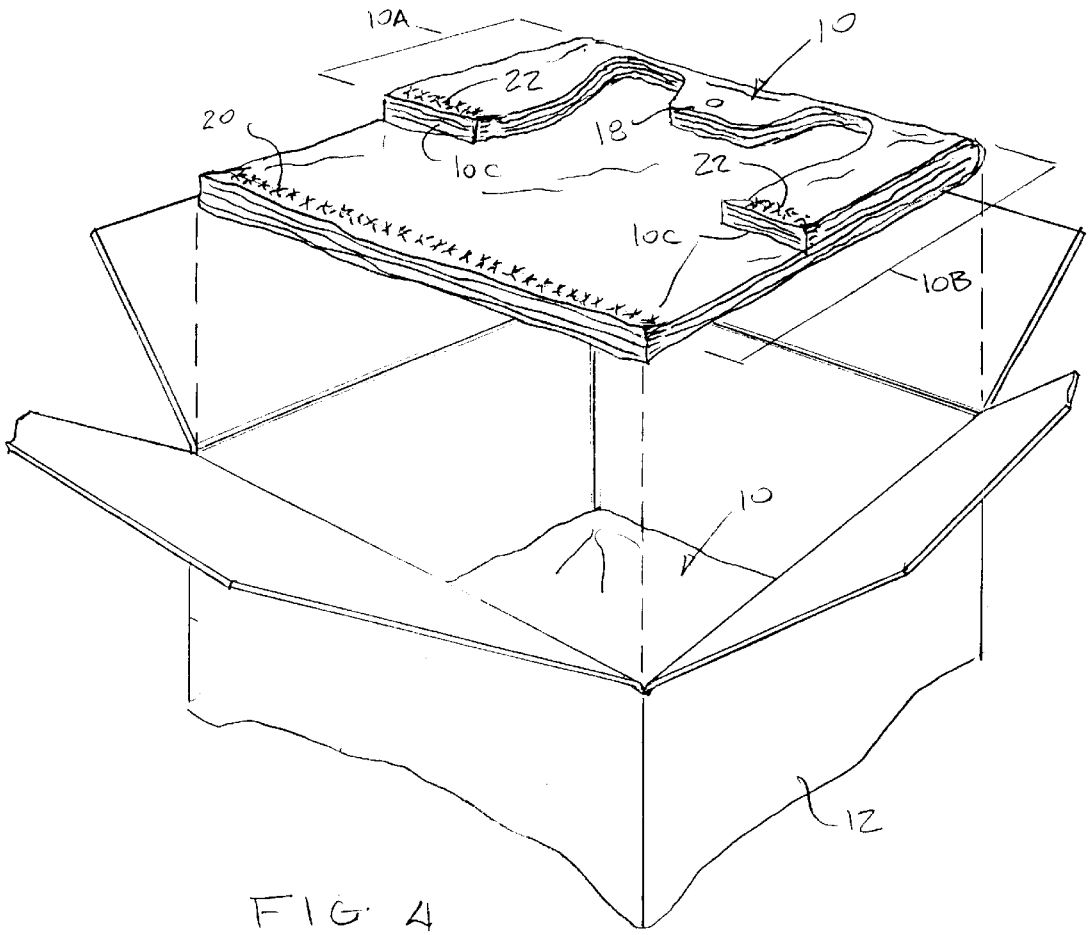
FIG. 3 is an exploded view of the preferred embodiment of the present invention.
Figure 4:
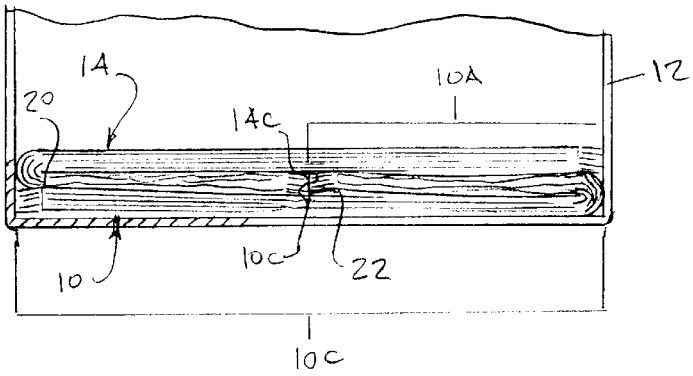
FIG. 4 is an end view of the preferred embodiment of the present invention.

FIGS. 3 and 4 show a preferred embodiment of the invention. A conventional bundle of T-shirt bags 10 is folded with the upper one third 10A encompassing the handle portion being folded over the bottom two thirds 10B as shown in the drawings. The upper edges 10C of the bundle falls at the half way point of the long portion 10B. The folded bundle is then placed in the bottom of the box. The next bundle 14 is folded in the same way and placed in the box as shown in FIG. 4 so that the upper edges 10C and 14C of the smaller portions abut against each other. In a sense the two bundles are "nested" together.

In the bags illustrated in FIGS. 3 and 4 each bag 10 includes a mounting tab 18. The bottoms and tops of the individual bags have seal lines 20 and 22, respectively which as noted above, increase slightly the thickness of the bags at the edges. With the nested arrangement as shown in FIG. 4, the bundles tend to lay flatter since the sealed edges fall at the ends of the folded bags as well as in the center. Since the number of sealed edges in a given package is the same at each of the three places, the variation in height is diminished.

The next pair of bundles (not shown) would be nested and packaged in the same way, and so forth until the desired number of bundles is packaged. With the nesting arrangement illustrated in FIGS. 3 and 4, the folded parts of the bundles are much less likely to shift during packing and shipping. As a result, the stack of bundles is less likely to topple and, therefore, self-supporting. This means that the sides of the box are not required to support the weight of the bundles. Typically, each box will contain twenty bundles (ten pairs) of fifty bags each or ten bundles (five pairs) of one hundred bags each although obviously the invention does not depend on the number of bundles or the number of bags in a bundle.

T-shirt bags of the type used in grocery stores and other similar retail establishments come in a number of predetermined sizes. In the prior art, when these bags are folded, they are very often almost square which is undesirable when a number of boxes are being stacked on a pallet. A subsidiary benefit of the invention is that with these conventional sizes, the boxes tend to be more rectangular. Rectangular boxes can be interlocked on a pallet which means that the stack of boxes on the pallet is more stable and therefore less likely to collapse than in the case of square boxes.

Plastic bags other than T-shirt bags are also commonly used throughout the world but for the most part such bags are not stacked and packaged in boxes as described herein. The invention, however, would be applicable to bags other than T-shirt bags.

In the preferred embodiment, a third of each bundle is folded over the remaining two thirds, but the invention also contemplates the possibility of folding the bundles in different proportions. For such arrangements it may be preferable to nest the bags by having the edges of the long portion of one bundle abut the edges of a short portion of an adjacent bundle.

What is claimed is:

1. A package of plastic bags, comprising a box;

a bundle of plastic bags folded so that one third of the bundle overlies the remaining two thirds, the bundle being placed in the box with the edges facing a first direction; and a second bundle of bags folded in the same way and placed in the box with its edges facing in a direction opposite said first direction, the edges of the short portions of the two bundles abutting each other.

2. A package according to claim 1, wherein the bags are T-shirt bags.

3. A package of plastic bags according to claim 2, wherein the area of the box is approximately equal to the area of the long portion of a bundle.

4. A package of plastic bags, comprising a box, a plurality of folded bundles of bags within the box, each bundle being folded to form a long portion and a short portion, the bundles being stacked so that the edges of two adjacent bags abut.

5. A package of plastic bags according to claim 4, wherein the edges of the short portions abut.

6. A package of plastic bags according to claim 5, wherein the edge of a short portion abuts the edge of the long portion of an adjacent bundle.

* * * * *